United States Patent [19]

La Forge, Jr.

[11] 3,947,838

[45] Mar. 30, 1976

[54] INTRUSION ALARM SYSTEM

[75] Inventor: Louis H. La Forge, Jr., San Mateo, Calif.

[73] Assignee: Tri-Century Industries, San Mateo, Calif.

[22] Filed: Oct. 29, 1974

[21] Appl. No.: 518,602

[52] U.S. Cl. ..... 340/276; 340/240

[51] Int. Cl.[2] ..... G08B 13/20

[58] Field of Search ..... 340/229, 276, 240

[56] References Cited

UNITED STATES PATENTS

| | | | |
|---|---|---|---|
| 3,748,656 | 7/1973 | Gray et al. | 340/240 |
| 3,829,851 | 8/1974 | Evans et al. | 340/240 X |

*Primary Examiner*—David L. Trafton

*Attorney, Agent, or Firm*—Flehr, Hohbach, Test, Albritton & Herbert

[57] ABSTRACT

An intrusion detection apparatus employing a pressure differential sensor for sensing an entry into a room, building or other enclosure. A fan maintains a pressure differential between the enclosure and the external environment and causes air flow through the sensor. Opening of doors and windows or other intrusions into the enclosure causes changes in sensor air flow and the generation of an electrical signal highly sensitive to the changes. A signal processor processes the signal based upon direction, amplitude and time-period of change to distinguish between intrusion-caused and non-intrusion-caused changes.

24 Claims, 8 Drawing Figures

INTRUSION ALARM SYSTEM

CROSS REFERENCE TO RELATED APPLICATION

ELECTRONIC COMBINATION SWITCH invented by Thomas S. Panages, Ser. No. 518,967, filing date Oct. 29, 1974 and assigned to SECURITY CORPORATION OF AMERICA.

BACKGROUND OF THE INVENTION

The present invention relates to the field of alarm systems and particularly to an intrusion detection apparatus for use in detecting intrusions into homes, stores, factories and other enclosures.

Prior devices for detecting intrusions have relied upon many different principles. For example, contact switches have been mounted on each door and window of an enclosure. Upon opening the door or window, the switch is actuated to set off an alarm. Similarly, radiation devices have been employed wherein an entry into the enclosure causes the radiation to be interrupted thereby setting off an alarm.

The desire for an improved and more economical intrusion detection apparatus has lead to devices relying upon differential air pressure between an enclosure and the external environment. Such an apparatus is described in U.S. Pat. No. 3,829,851 and in patents cited and discussed therein. These differential pressure devices present a problem in that they must be both sensitive enough to detect significant changes and able to distinguish between intrusion-caused and non-intrusion-caused changes. Non-intrusion-caused changes frequently arise from changes in the external atmosphere such as changes in wind velocity and wind direction. Also flues, vents and normal leaks present problems which must receive compensation. Prior intrusion detection apparatus has not been adequately sensitive to detect changes or has not adequately distinguished between intrusion-caused and non-intrusion-caused changes.

In view of the above background of the invention, it is an object of the present invention to provide an improved differential-pressure intrusion detection apparatus which is highly sensitive to changes while having the ability to distinguish between intrusion-caused and non-intrusion-caused changes.

SUMMARY OF THE INVENTION

The present invention is an intrusion detection apparatus for detecting intrusions into an enclosure. A pressure differential is maintained between the enclosure and the external environment. A differential sensor provides electrical signals highly sensitive to differential pressure changes between the enclosure and the external environment. A signal processor in combination with the characteristics of the sensor distinguishes between intrusion-caused changes and non-intrusion-caused changes.

In one feature of the invention, the signal processor detects changes which occur within a time window which is a time-period occurring after a predetermined minimum time and before a predetermined maximum time.

In a further feature, the signal processor accumulates only selected unidirectional changes which can be caused by an intrusion.

In a still further feature, the signal processor detects only changes of a large enough amplitude to be caused by an intrusion.

In one preferred embodiment of the present invention, the differential sensor includes an unbalanced vane device where the vane operates against gravity and is positioned as a function of the rate of air flow between the enclosure and the external environment. The vane is movably located between a lamp and a plurality of photocells. The shadow from the vane allows the photocells to detect the position of the vane and changes in position of the vane.

A preferred differential sensor includes a vane follower for providing an adjustable gap between the vane and the vane follower where the static and dynamic characteristics of vane position as a function of air flow are adjustable. Additional features include surge chambers, baffles, non-linear throttles, and tandem sensors for adjusting and controlling static and dynamic characteristics.

In one preferred embodiment, a directional sensor circuit includes a plurality of pulse generators, one associated with each photocell in the differential sensor. Each pulse generator generates a pulse for each transition of the corresponding photocell between on and off conditions. The outputs from all pulse generators are connected in common and summed in an integrator. The voltage across the integrator is a function of the movement of the vane in the differential sensor and hence is a measure of the change in air flow and the change in differential pressure between the enclosure and external environment. The change in air flow may result from any intrusion into the enclosure or from changes in environment due to wind and other variables. The integrator has unilateral characteristics so as to accumulate a signal of polarity corresponding to the polarity of pulses having a direction (sign) which can be caused by an intrusion. For a positively pressurized enclosure, an intrusion necessarily results in a decrease in pressure and hence the unilateral integrator produces a signal resulting from the accumulation of pulses produced by reductions in pressure and does not produce a signal resulting from the accumulation of pulses produced by increases in pressure.

A feature of signal processor of the present invention is a validating circuit which senses that proper differential pressure conditions have been established before arming the intrusion detection apparatus. Another feature limits access to and control of the apparatus to authorized persons.

In accordance with the above summary of the invention, the present invention achieves the objective of providing an improved intrusion detection apparatus wherein a differential pressure sensor and signal processor distinguish between non-intrusion-caused changes, such as from wind and other variables, and intrusion-caused changes to provide reliable intrustion detection.

DETAILED DESCRIPTION

Figure 1:
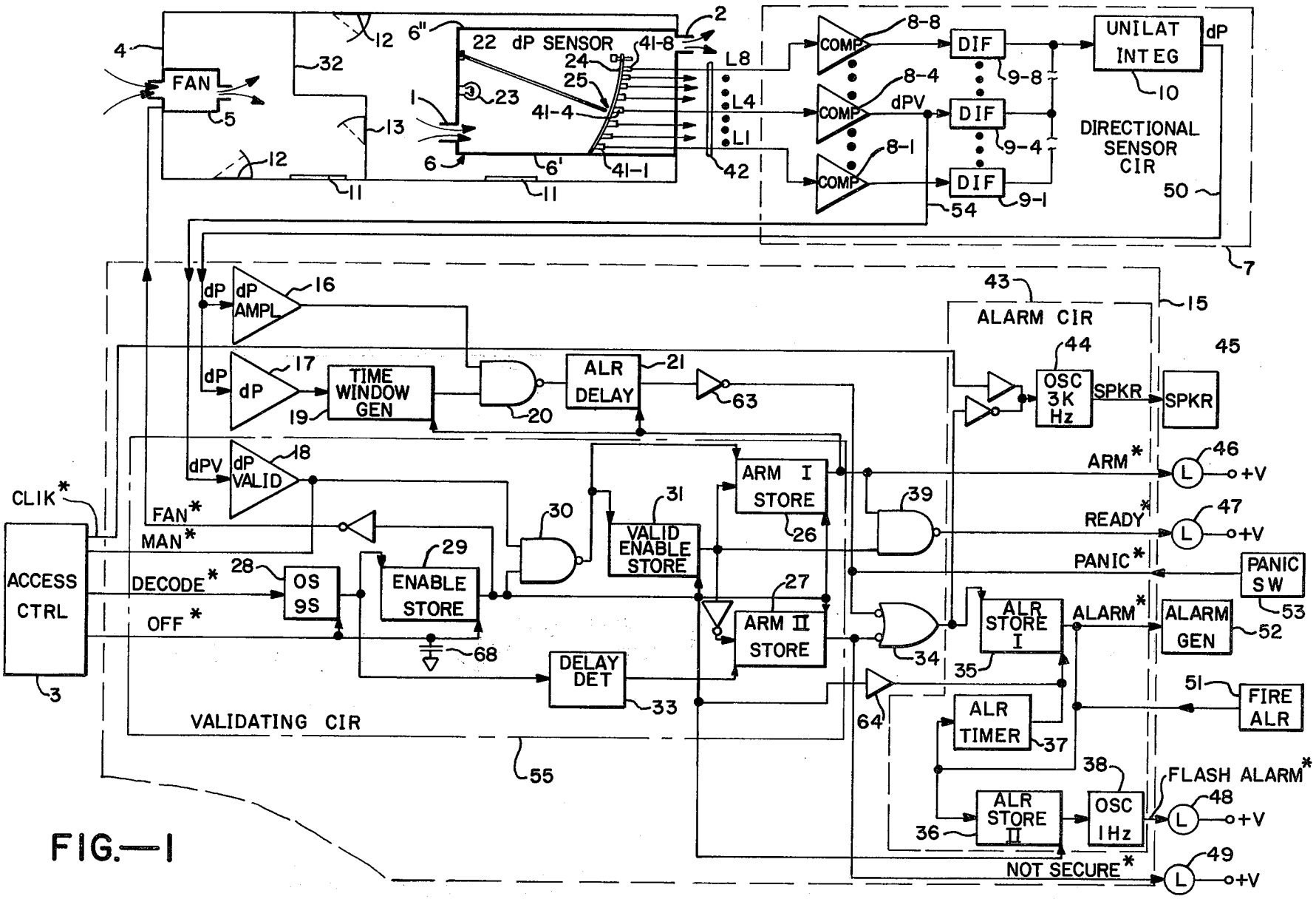
FIG. 1 depicts an overall block diagram of an apparatus in accordance with the present invention.

Referring to FIG. 1, the basic system includes an enclosure 4 which is typically a room, house, or store but can be any substantially enclosed volume. While the invention is particularly directed to an intrusion detection apparatus for providing an intrusion alarm based upon differential air pressure, the invention may be used in many applications utilizing other gases or liquids as the medium which supports the pressure difference.

In FIG. 1, a fan 5 is utilized to maintain a differential pressure between the external environment outside the enclosure 4 and the volume inside enclosure 4. The differential pressure sensor 6 is located with an internal port 1 and an external port 2 for allowing air, forced by fan 5, to flow through sensor 6. For a positive pressure within the enclosure, air flow is from the enclosure, into the internal port 1 and out through the external port 2. Of course, the present invention can be employed with a fan which partially evacuates the enclosure 4 in which case, the sensor 6 is reversed in direction with the port 1 connected to the internal environment.

Differential Sensor — FIG. 1

The sensor 6 includes an unbalanced movable vane 14 connected to rotate around a pivot point 22. In the preferred embodiment of FIG. 1, the bottom 6′ is down with respect to gravity and the top 6″ is up with respect to gravity so that a gravitational restoring force operates on vane 14. While in a preferred embodiment gravity acts as a restoring force, other forces can be employed. For example, springs or other elastic members, electrostatic forces, magnetic forces, fluid pressure, gas pressure or any combination of these may be applied directly or indirectly to restore vane 14. The operation of the fan 5 causes air to flow into port 1 and out of port 2. In so doing, the air flow raises vane 14 up from wall 6′ toward wall 6″. The position of vane 14 is therefore a measure of the differential pressure which determines the rate of air flow through sensor 6.

In FIG. 1, the differential sensor 6 includes a vane follower 24 which is fixed in a position which substantially describes an arc about the pivot point 22. Follower 24 therefore establishes a gap 25 between follower 24 and the vane 14. The size of the gap 25 and the variation in the gap width as a function of vane position partially determine the static and dynamic characteristics of the vane position as a function of air flow. Many other factors also control the characteristics, particularly vane mass, vane shape, and amplitude of the restoring force. Vane follower 24 has a plurality of photocells 41—1 through 41—8 which are positioned to detect light from a lamp 23. Of course, any plurality of photocells can be employed. Lamp 23 illuminates those of the photocells 41 that are not within the shadow of vane 14. The detecting and non-detecting light condition of the photocells 41—1 through 41—8 define the position of vane 14 and responsively provide output signals on lines L1 through L8 indicating the detecting (light) or non-detecting (dark) states of the photocells.

The operation of the present invention relies upon an air pressure differential, typically established by fan 5, between the interior and exterior of the enclosure 4. When a differential air pressure has been established, air flows through the sensor 6 causing vane 14 to overcome the restoring force of gravity and to be positioned at an equilibrium point which, for example, is somewhere above photocell 41—4.

In a typical example, enclosure 4 has windows 11, doors 12 in the external walls which, when closed, still are a source of air leaks between the enclosure and the external environment. Additional sources of the air leaks, such as joints between framing and siding and such as fireplace flues, are frequently present. Notwithstanding these leaks, however, fan 5 is operated to establish sufficient air flow into the structure 4 and through sensor 6 to cause vane 14 to assume an equilibrium position.

The enclosure 4 typically includes one or more internal walls such as wall 32 which tends to separate the fan 5 from the sensor 6. Under normal conditions, the air leaks around internal doors such as door 13 are sufficient to provide sufficient air-flow between fan 5 and sensor 6 so that no additional openings are required. Of course, if the air leaks normally existent through the internal walls of enclosure 4 do not permit sufficient air-flow, the bottoms of doors can be trimmed or ports may be inserted through walls or doors to provide sufficient air flow.

After air flow through sensor 6 has established vane 14 at an equilibrium position, any new opening, such as by opening a door, between the enclosure 4 and the external environment will disturb the air flow through sensor 6 and hence will cause vane 14 to move down from its equilibrium position. Since any entry to the enclosure 4 requires some opening, detector 6 readily identifies the change from the equilibrium condition and responsively provides output signals on lines 42.

The sensor circuit 7 functions to detect the signals on lines 42 and inputs them to the digital processor 15 which, under appropriate conditions, causes one or more alarm signals to be generated.

While an unauthorized entry into the enclosure 4 will cause a change in the equilibrium condition and will be detected by sensor 6, other non-intrusion phenomena can cause changes from the equilibrium condition which are detected by sensor 6. Of particular interest is the behavior of the external atmosphere surrounding the enclosure 4. Wind direction and wind velocity strongly affect the differential air pressure between the inside and outside of an enclosure. For some buildings, wind in one direction tends to raise the internal pressure while wind in another direction tends to decrease it. Of course, many combinations between the maximum increase and the maximum decrease are possible. Generally wind gusts resulting from rapid changes in wind velocity or direction make correspondingly rapid but generally unpredictable changes in the differential air pressure. These effects tend to add or subtract continually from the differential pressure provided by the fan 5.

An effective intrusion detection apparatus, therefore, based on differential pressure must be able to distinguish between atmospheric-caused changes in the equilibrium condition and intrusion-caused changes in the equilibrium condition.

In accordance with the present invention, it has been found that with a few unimportant exceptions, man-made entries (e.g. through a door) into an enclosure cannot be accomplished in a time-period shorter than a minimum time and also will be completed in a period which does not exceed a maximum time. In accordance with the present invention, any change in the equilibrium condition which occurs in a shorter time than the minimum time or over a longer time than the maximum time is automatically classified by the apparatus of FIG. 1 as a non-intrusion change.

Very slow changes in the equilibrium state of sensor 6 are typically caused by gradual changes in wind direction. These slow changes are rejected by the signal processor. Similarly, the changes in equilibrium by wind gusting frequently are of short duration and hence are ignored by the signal processor. Other gusting phenomena are rejected since they cause a differential change from equilibrium in a direction opposite to changes resulting from man-made intrusions. Specifically man-made entry (for example through a door) to the enclosure 4 necessarily results in a reduction of air flow through sensor 6. Accordingly, air gusts which cause an increase in air flow through sensor 6 can be ignored. Additionally, gusting or other phenomena which cause a change in air flow through sensor 6 which, while in the same direction as a man-made change, can be rejected if they are of small enough amplitude as compared with the amplitude of changes resulting from man-made intrusions.

In order to account for the above factors, the apparatus of FIG. 1 operates on the basis of time response, amplitude, and direction of changes from an equilibrium condition to distinguish between changes caused by intrusions into the enclosure 4 and changes caused by atmospheric or other conditions.

Directional Sensor — FIG. 1

In FIG. 1, the directional sensor circuit 7 is responsive so as to accumulate directionally signals from sensor 6. Circuit 7 functions to sense the photocell outputs on lines 42 to provide a differential pressure (dP) signal on line 50. The eight lines L1 through L8 connect to comparators (COMP) 8—1 through 8—8, respectively. Comparators 8 function to detect the on (light) or off (dark) condition of the photocells 41. Each time vane 14 passes one of the detectors 41, a corresponding comparator 8 produces an output pulse (high to low or low to high). The outputs from comparators 8—1 through 8—8 are input to the differentiators 9—1 through 9—8, respectively. The differentiators differentiate pulses from comparators 8 and have their outputs connected in common as an input to the unilateral integrator 10. Integrator 10 sums the pulses from differentiators 9 to provide the signal dP on line 50.

By way of example, it is assumed that an intrusion occurs into the enclosure 4, and that vane 14 responsively crosses three photocells 41 causing them to go from on to off. The corresponding comparators and differentiators 8 and 9 produce three output positive pulses to integrator 10. Those three pulses are summed in integrator 10 to produce a signal dP of amplitude 3. The amplitude of positive 3 indicates a movement of vane 14 across three photocells. By way of another example, it is assumed that a change in environmental condition causes vane 14 to move across two photocells turning them from off to on and producing two negative-going pulses. Integrator 10 is unilateral and cannot store a negative signal. If the integrator 10 stored zero change at the time it received the two negative pulses, the charge would remain zero. If it stored a positive 4 which initially would cause an output from comparator 16 to enable gate 20 then it would be reduced thereafter to positive 2. The directional nature of integrator 10 is significant in that it will not accumulate in a direction opposite to the direction of an intrusion and hence an intrusion cannot be missed because of accumulated signals in the wrong direction. The dP signal output from the integrator 10 on line 50 is a function of a unidirectional (downward) change in position of the vane 14. The directional sensor 7 is a means responsive to the differential sensor 6 for directionally detecting changes in differential pressure in a direction in which intrusions cause changes in differential pressure.

Digital Processor — FIG. 1

The output signal on line 50 is input to the digital processor 15. In processor 15, the dP signal is detected by the comparator (dP AMPL) 16 to determine if its amplitude is above a predetermined threshold and therefore is large enough to signify an intrusion. In a typical example, comparator 16 is set to detect a signal resulting from movement of the vane 14 past a predetermined number of photocells where the total number of photocells in an array is eight, the predetermined number for detection is typically three. Where a larger number of photocells is employed for greater resolution, the predetermined number required for detection is changed, for example, to five. Of course, the number of photocells required can be varied to adjust the sensitivity of the system and the variance is made by varying the threshold amplitude input to comparator 16. When vane 14 has moved past the selected number of photocells, comparator 16 outputs a signal to NAND gate 20. Comparator 16 is, therefore, a means for detecting changes in an electrical signal from sensor 7 which exceed a predetermined amplitude.

the dP signal on line 50 from sensor 7 is also input to a comparator 17 which is set at a level to detect movement of vane 14 past one or more photocells. When vane 14 has moved past at least one photocell, comparator 17 outputs a signal to the time window generator 19. Generator 19 responsively produces an output to NAND gate 20 after a minimum delay time and ending at a maximum delay time. The output from generator 19 therefore provides a time window (between the minimum and maximum times) during which the output from the amplitude comparator 16 can satisfy NAND gate 20. The comparator 17 and generator 19 are time window generator means for providing an intrusion detection period between a minumum time and a maximum after the electrical signal from the sensor 7 indicates a change in flow through the differential sensor 6.

NAND gate 20 becomes satisfied to produce an output to alarm delay (ALR DELAY) 21 only when the movement of the vane 14 of sensor 6 has satisfied three conditions. The first condition is that the vane 14 must move in a direction which can be caused by intrusion. This first condition is detected by the directional sensor circuit 7. The second condition is that the amplitude of the movement must exceed a predetermined amplitude (for example, movement past 3 photocells). This second condition is determined by the amplitude comparator (dP AMPL) 16. The third condition is that a movement satisfying the first two conditions must produce an input to gate 20 from comparator 16 at a time which is within a time window period determined with respect to an initial movement. The third condition is provided for by comparator 17 which detects an initial movement and the time window generator 19. When the three conditions have been met, NAND gate 20 energizes the delay circuit 21 which produces an output signal for a fixed period which is, for example, 30 seconds. Delay 21 is selected to have a delay period useful for allowing an authorized person to disable the apparatus when it is not desired to produce an alarm. Of course, the duration of delay 21 can be changed at will or removed entirely. The output from delay 21 is connected through inverter 63 to NAND gate 34 (an OR gate with inverting inputs). NAND gate 34 has its other input from the VALIDATING CIRCUIT 55. Validating circuit 55 enables the NAND gate 34 to actuate oscillator 44 to produce a warning tone and to pass an alarm signal from the alarm delay 21 and inverter 63 to set the alarm store (ALR I STORE) 35. The warning tone and setting of store 35 are described hereinafter.

Validating Circuit — FIG. 1

The validating circuit 55 is set with a 1 output to enable NAND gate 34 when basically two conditions are met. The first condition is that vane 14 of sensor 6 be initially positioned in the equilibrium state. The position of vane 14 in the equilibrium state is detected by sensing that a preselected one of the photocells 41 receives light. In a preferred embodiment, the fourth photocell 41—4 is the preselected photocell but, of course, any one of the photocells may be selected depending upon the air flow characteristics of sensor 6 and depending upon the total number of photocells in the array. The output from comparator 8–4 provides a signal dPV on line 54 which indicates when vane 14 has been raised to the equilibrium condition above photocell 41—4. This dPV signal is input to the pressure valid comparator (dP VALID) 18. Comparator 18 produces a 1 output whenever vane 14 of sensor 6 is properly in the equilibrium state. In this condition, comparator 18 provides one input to NAND gate 30. Comparator 18 is a means for detecting when a predetermined flow of air has been established in the sensor 6.

Gate 30 receives its other input from the ENABLE STORE 29 in validating circuit 55. Store 29 is set through a one-shot 28 by means of a DECODE* signal from the access control (ACCESS CTRL) 3. Control 3, in one preferred embodiment, is a coded push-button lock which, when properly sequenced, outputs the DECODE* signal. Alternatively, control 3 may be a key operated lock or other switch mechanism which is operated when it is desired to provide the DECODE* signal and enable the apparatus of FIG. 1. Control 3 also outputs an OFF* signal which may be operated to disable the apparatus of FIG. 1. Further details of one preferred embodiment of control 3 are described in the above cross-referenced application which application is herein incorporated by reference in its entirety for the purpose of teaching a control suitable for generating the input signals employed in the present invention.

The DECODE* signal from control 3 is immediately propagated through the one-shot 28 to set the enable store 29 and thereby to enable NAND gate 30, to produce the FAN* signal which starts fan 5, and to remove the clear input from stores 26, 27, 31, 35 and 36. When comparator 18 signifies that energization of fan 5 has caused sensor 6 to be in the equilibrium state, gate 30 is satisfied and clocks VALID ENABLE STORE 31 to store a 1. At the same time that store 31 is clocked, the output from NAND gate 30 is input to the ARM I STORE 26. At the time that store 26 is clocked, store 31 has not stored a 1 and hence store 31 provides a 0 input to store 26. Accordingly, store 26 does not change states at this time and continues to provide a 1 for the ARM* signal to lamp 46. With a 1 for the ARM* signal, lamp 46 is not illuminated indicating that the FIG. 1 apparatus is not yet armed. Prior to the pulse from NAND gate 30, store 26 remains cleared since store 26 was originally held cleared by enable store 29. At this time, the 1 for the ARM* signal from store 26 is input to enable NAND gate 39 and to hold time window generator 19 and delay 21 cleared. At the time that store 31 becomes set by NAND gate 30, store 31 provides a 1 to NAND gate 39 which together with the 1 from store 26 produces a 0 for the READY* signal. A 0 READY* signal illuminates lamp 47 thereby indicating the ready condition of the FIG. 1 apparatus.

The ARM II STORE 27 like store 26 is also clocked to store the contents of the valid enable store 31. Store 27, however, is clocked later than store 26 by the trailing edge output from the one-shot (OS) 28 through a delay detector (DELAY DET) 33. Detector 33 functions to produce an output only on a trailing edge of the one-shot 28. The purpose of one-shot 28 and detector 33 is to provide a delay sufficient for the fan 5 to pressurize the enclosure 4 and move the vane 14 above photocell 14—4 to an equilibrium position. In one typical example, one-shot 28 is nine seconds so that detector 33 provides an output pulse nine seconds after the enable store 29 has enabled the fan 5 via the FAN* signal. Of course, any delay period may be selected provided it is long enough to insure that the initial equilibrium state has been reached. By the time that the nine-second delay has occurred to produce an output from detector 33, the valid enable store 31 has been clocked to store a 1. The 1 from store 31 is inverted as a 0 input to store 27 so that store 27 continues to provide a 1 on its inverted output. The 1 from store 27 enables NAND gate 34 and via the NOT SECURE* signal keeps lamp 49 extinguished. If comparator 18 had not detected the equilibrium condition for sensor 6, gate 30 would not have been satisfied, store 31 would have remained at 0, and store 31 would not have been clocked to provide a 0 on its inverted output. Under these conditions, the not secure lamp 49 would have been illuminated. Also a 0 from store 27 forces NAND gate 34 to produce a 1 output which generates a warning sound through oscillator (OSC) 44 as hereinafter described.

When enable store 31 has been clocked and stores a 1, the apparatus of FIG. 1 is ready to be switched from the ready state to the armed state. The apparatus can be armed in one of two ways. It can be manually armed by a MAN* signal from the access controller 3 or with an opening into enclosure 4, for example, by opening a door. In either case, a negative-going pulse on the output from comparator 18 occurs which is input as a 1-0-1 transition to NAND gate 30. Gate 30 responsively has a 0-1-0 transition on its output which again clocks stores 26 and 31. Since store 31 already stores a 1, its output does not change. Store 26, however, now stores a 1 as input from store 31. The inverted output ARM* signal is therefore switched to 0 thereby disabling NAND gate 39 forcing the READY* signal to 1 and extinguishing the lamp 47. A 1 for the ARM* signal removes the clear signal from the window generator 19 and the delay 21 so that they are now enabled to process signals from the directional sensor circuit 7. Also, a 0 from the ARM* signal store 26 illuminates lamp 46 thereby indicating that the apparatus is armed.

Alarm Circuit — FIG. 1

Whenever an intrusion occurs into enclosure 4 so as to allow air to escape and hence be diverted from flowing through sensor 6, the intrusion is detected by the sensor 6 which provides signals to circuit 7. If the intrusion satisfies the directional condition of directional sensor 7, the amplitude condition of comparator 16, and the time window condition of generator 19, a signal is propagated through NAND gate 34 to the ALARM CIRCUIT 43 provided gate 34 is enabled with a 1 by the validating circuit 55. When enabled with a 1 from circuit 55, the signal from gate 34 is initially 1 to enable oscillator 44 followed by a negative-going transition which clocks ALARM I STORE 35 to store the alarm condition. Store 35 outputs a 0 ALARM* signal which energizes the alarm generator (for example a bell or a horn) 52. At the same time, the ALARM* signal is input to an alarm timer (ALR TIMER) 37 which functions to reset store 35 after a predetermined period. When the output from validating circuit 55 and store 27 is 0 as occurs when vane 14 does not reach equilibrium above photocell 41—4, gate 34 is forced to provide and maintain a 1 output which continuously enables oscillator 44 and does not clock store 35.

The alarm timer 37 is typically set for 10 minutes thereby allowing the alarm 52 to sound for 10 minutes. Of course, any time period desired can be selected. After the delay period of timer 37, store 35 is reset thereby switching the ALARM* signal to 1 which terminates the operation of generator 52. The initial 0 for the ALARM* signal is also input to ALARM II STORE 36. Store 36 unlike store 35, is not reset by the operation of timer 37 but is reset only by a clear signal which is a 0 from enable store 29. As long as enable store 29 stores a 1, store 36 provides an output to an oscillator (OSC) 38. Oscillator 38 is typically of 1Hz frequency and operates to provide a FLASH ALARM* signal which causes lamp 48 to flash on and off at a 1Hz rate. Even though the alarm 52 is turned off by a alarm store 35, the flashing lamp 48 continues to flash thereby indicating that the alarm has been previously sounded.

The output from NAND gate 34 functions to clock the store 35 on a negative-going output from gate 34. A negative-going transition is provided by delay 21. During the period when delay 21 is active its output is 1. That 1 is inverted in inverter 63 to 0 thereby forcing the output from gate 34 to 1. A 1 output from gate 34 enables the oscillator 44. Oscillator 44 is typically a 3KHz oscillator for providing a tone signal to speaker (SPKR) 45. During the period when delay 21 is active (1), the output from gate 34 is 1 and hence speaker 45 is active with a warning signal to warn that an alarm is about to be sounded. Delay 21 in one preferred example is 30 seconds. Of course, any delay period can be selected during which a warning tone signifies that an alarm is to be sounded. The alarm actually is sounded at the trailing edge of the output from delay 21. The trailing edge causes a 1 to 0 transition from gate 34 which clocks store 35 to sound the alarm. The output from gate 34 can also be utilized to sound the warning tone from speaker 45 if the output from ARM II store 27 is 0. A 0 occurs from store 27 if comparator 18 fails to detect the equilibrium condition for sensor 6. NAND gate 30 is not satisfied and store 31 is not clocked so that it remains cleared and provides a 1 input to store 27. When store 27 is clocked, it stores the 1 so that its inverted output is 0. The 0 output from store 27 forces the output from gate 34 to 1 thereby triggering the speaker 45 warning tone.

During the 30 second warning period, intervention by the access control circuitry may disable the system and prevent the alarm. If the DECODE* signal is again energized with a 0, one-shot 28 fires and again clocks store 29. Store 29 switches states on each input clock and since it was storing a 1 it switches its output to 0. The 0 output from store 29 clears the stores 26, 27, 31, 35 and 36 thereby preventing an alarm from occurring until the system is again enabled and armed.

The alarm system of FIG. 1 is also capable of sounding alarms from external controls. For example, a panic switch 53 is provided for setting the alarm store 35 for triggering the alarm generator 52 provided valid enable store 31 is set. Also a firealarm system generally indicated by box 51 may be interconnected to utilize the alarm generator 52 and the flashing alarm lamp 48.

Figure 2:
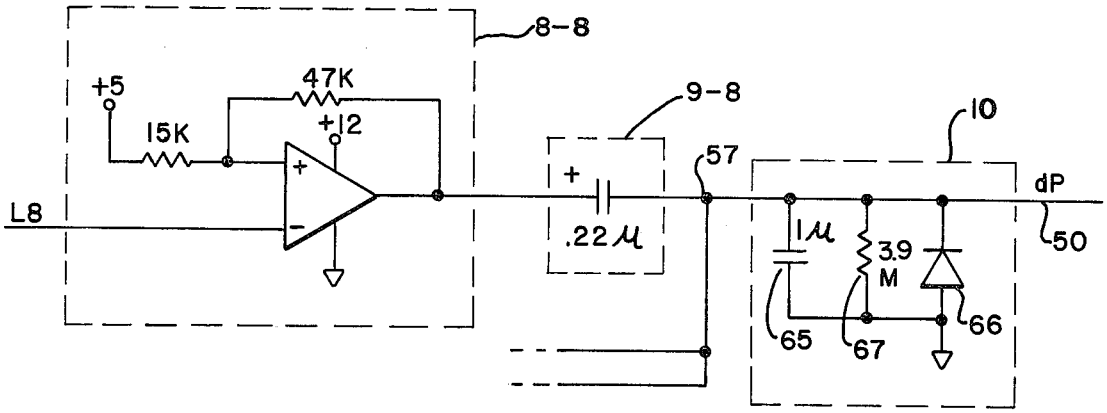
FIG. 2 depicts details of the directional sensor circuit which is part of the signal processor of the FIG. 1 apparatus.

Directional Sensor — FIG. 2

In FIG. 2, details of the directional sensor circuit 7 of FIG. 1 are shown. Comparator 8—8 is typical of all the comparators in FIG. 1. Comparator 8—8 is a conventional amplifier which provides a high output whenever the corresponding photocell is dark and a low output whenever the corresponding photocell is illuminated. Transitions from light to dark and from dark to light are differentiated by differentiator 9—8 which in a typical embodiment is a 0.22 microfarad capacitor. The output from capacitor 9—8 is a positive-going spike for light to dark transitions of the corresponding photocell and is a negative-going spike for dark to light transitions. The output from the differentiator 9—7 is input through summing node 57 to the unilateral integrator 10. Summing node 57 receives the input from each of the differentiators 9—1 through 9—8 of FIG. 1.

The unilateral integrator 10 is comprised of the parallel connection of a 1 microfarad capacitor, a 3.9M ohm resistor and a diode. Negative-going spikes into node 57 from anyone of the differentiators 9 tend to place a negative charge across capacitor 65. The diode 66 acts as a short circuit to ground preventing the voltage on capacitor 65 from going more negative than approximately ground. Positive-going pulses from differentiators 9, however, are input to the capacitor 65 and are accumulated to provide a positive voltage. The positive voltage, however, decays through the 3.9M resistor 67 and the other circuit components at a rate of about ⅓ reduction in three seconds. The output signal from integrator 10 is input to the signal processor of FIG. 1 which is shown in greater detail in FIG. 3.

Figure 3:
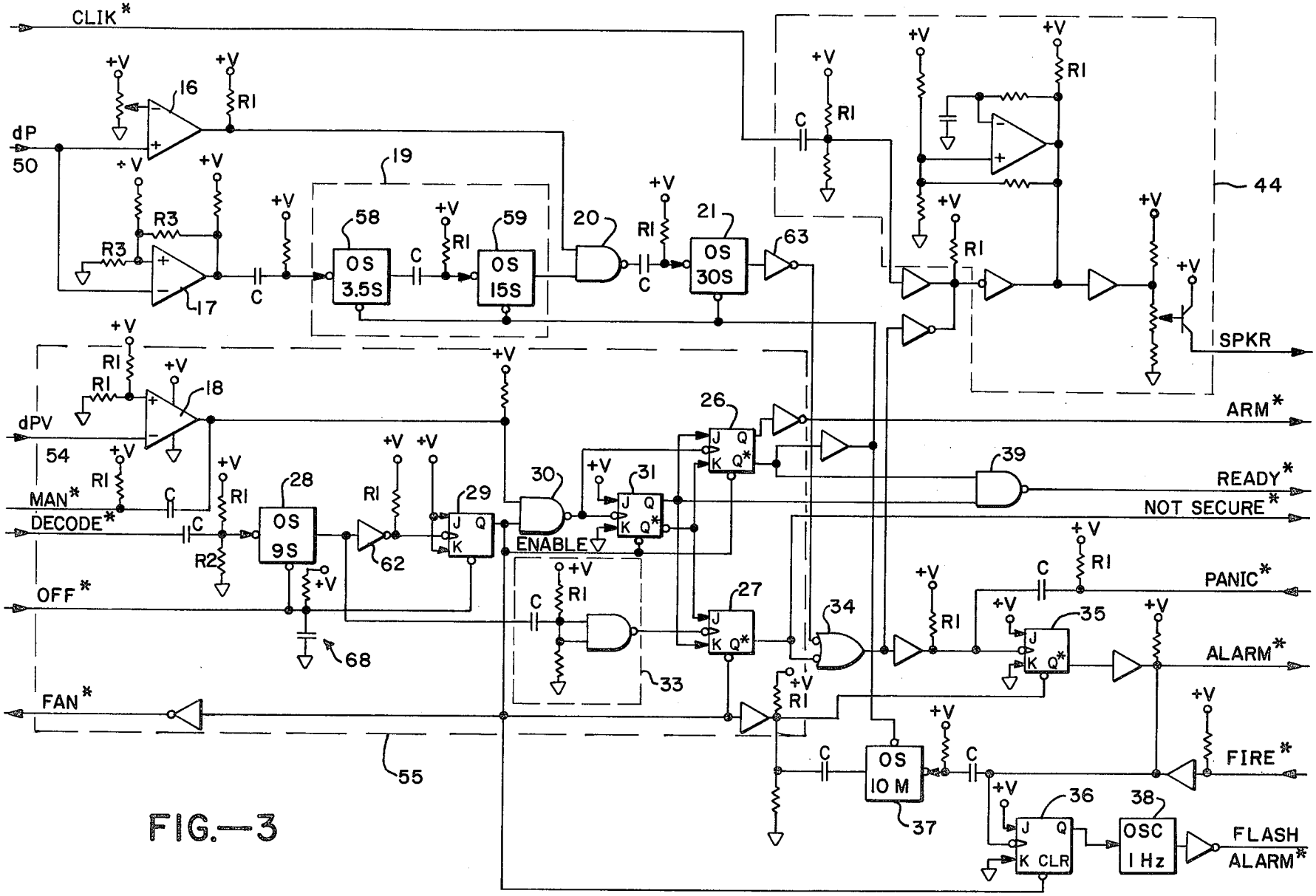
FIG. 3 depicts a schematic representation of a part of the singal processor within the FIG. 1 apparatus.

Digital Processor — FIG. 3

In FIG. 3, the conventional comparator 16 is biased, on its negative input, to detect input signals on line dP which represent a change in differential pressure which exceeds a predetermined amplitude. In a preferred embodiment, the predetermined amplitude is one which results when vane 14 causes at least three photocells to have a light to dark transition. When three such transitions have occurred, the output from comparator 16 is a logical 1 which is input to NAND gate 20 as previously described in connection with FIG. 1. The variable resistor tap input to comparator 16 may be adjusted to select a different number of photocell transitions.

In FIG. 3, the conventional comparator 17 also receives the dP signal on line 50. The comparator 17 is set to a threshold level to produce a negative-going output whenever the sensor 6 of FIG. 1 causes a photocell to go from light to dark. A negative-going transition from comparator 17 triggers the one-shot 58. The one-shot 58, in one preferred embodiment, has a 3.5 second time out. One-shot 58 has a positive-going output, when triggered by the amplifier 17, which remains positive for 3.5 seconds and falls with a negative-going output. The negative-going output from one-shot 58 triggers the one-shot 59 which, in one preferred embodiment, has a 15 second time out. One-shots 58 and 59 together form the time window generator 19.

The output from the one-shot 59 remains 1 for a period of 15 seconds after being triggered by the negative-going transition from one-shot 58. During this 15-second period, a time window is provided during which NAND gate 20 is enabled. If gate 20 receives a 1 from amplifier 16 during this 15-second period, the output from gate 20 is responsively a negative going spike which triggers one-shot 21. The output from one-shot 21 will therefore be 1 for 30 seconds. That 1 is inverted in inverter 63 to provide a 0 input to NAND gate 34. The 0 input to gate 34 holds the gate 34 output at 1 for 30 seconds. Provided gate 34 also receives a 1 from the Q* output of JK flip-flop 27, gate 34 will have a negative-going transition after the 30 second time out of one-shot 21.

Flip-flop 27 is a conventional JK flip-flop and provides an output from the validating circuit 55 as previously discussed in connection with FIG. 1. The validating circuit 55 receives MAN*, DECODE*, and OFF* signals from the access control 3 of FIG. 1. Also the validating circuit 55 receives the dPV signal from the comparator 8—4 of FIG. 1. The dPV signal is input to the conventional comparator 18 which produces a 1 output when the photocell 41—4 receives light and a 0 output when the photocell 41—4 is dark. The 1 or 0 at the output from comparator 18 can also be controlled by the MAN* signal. Comparator 18 produces a 1 output whenever the vane 14 is above the diode 41—4 for validating that the desired differential pressure is present.

The other input to NAND gate 30 derives from conventional JK flip-flop 29. When the DECODE* signal appears as a negative-going pulse it triggers the one-shot 28 which in one preferred embodiment has a 9-second time out. The output from one-shot 28 is a positive pulse the leading edge of which is inverted in inverter 62 to clock the conventional JK flip-flop 29. Flip-flop 29 initially stores a 0 on its Q output as initially established by a 0 OFF* signal. The 0 OFF* signal is provided either by control 3 of FIG. 1 or through capacitor 68 at power on time. Since the J and K inputs of flip-flop 29 are both 1's, flip-flop 29 changes state each time it is clocked. When clocked by one-shot 28, flip-flop 29 produces a 1 on its Q output which is input to NAND gate 30 and which removes the clear input from conventional flip-flops 26, 27, 31, 35 and 36.

Whenever NAND gate 30 becomes satisfied with a 1 from comparator 18 and a 1 from flip-flop 29, its output has a negative-going transition which clocks conventional JK flip-flops 26 and 31. Just prior to receiving a clock signal from NAND gate 30, flip-flops 26 and 31 have been held cleared by the Q output from flip-flop 29. The J and K inputs to flip-flop 26 are derived from Q and Q* outputs of flip-flop 31. On the first negative-going pulse from gate 30, the 0 and 1 from the Q and Q* outputs from flip-flop 31 are clocked into the J and K inputs of flip-flop 26 so that flip-flop 26 does not change states leaving a 1 on its Q* output and a 0 on its Q output. At the same instance, flip-flop 31 is clocked and changes states to provide a 1 on its Q output and a 0 on its Q* output.

The delay detector 33 includes a NAND gate connected as an inverter. The input to the gate is biased positive so that the positive-going transition output from one-shot 28 in response to a DECODE* signal does not change the 0 output from detector 33. The negative-going transition, after 9 seconds at the trailing edge of the output from one-shot 28, momentarily drives the inputs to the NAND gate of detector 33 to 0. The output from detector 33 is responsively a 1 to 0 to 1 transition and the negative-going transition triggers the flip-flop 27. The negative-going position of the transition from detector 33 occurs after the 9-second time out of one-shot 28.

Flip-flop 27 is clocked by detector 33 to store a 1 or 0 as determined by flip-flop 31. Since flip-flop 31 has a 1 and a 0 on its Q and Q* outputs, the K and J inputs receive a 1 and 0, respectively. Accordingly, flip-flop 31 does not change state and the Q* output remains a 1 after being clocked by circuit 33. If flip-flop 31 is set with a 0 and a 1 on its Q and Q* outputs, respectively, then flip-flop 27 stores a 0 on its Q* output when clocked by circuit 33. That 0, of course, causes the warning tone to be generated.

The operation of the NAND gate 34 in FIG. 3 is the same as previously described in connection with FIG. 1. When the output from gate 34 is a 1, it enables the conventional oscillator 44 and associated circuitry to provide a 3K Hz signal on the SPKR line to generate the warning tone. A negative-going transition from gate 34 clocks conventional JK flip-flop 35 which responsively provides a 0 output for the ALARM* signal all in the manner previously described in connection with FIG. 1.

The output from flip-flop 35 clocks the conventional JK flip-flop 36 causing it to store 1 on its Q output and to energize the oscillator 38 all in the manner previously described. The output from flip-flop 35 also clocks the 10-minute one-shot 37 which has its output connected as the clear input to flip-flop 35. After the 10-minute time out of one-shot 37, flip-flop 35 is cleared to produce a 1 on its Q* output.

All of the circuits in FIG. 3 are conventional and are one preferred embodiment of the digital processor 15 of FIG. 1. The circuitry of FIG. 3 can be implemented in many different ways and equivalent substitutions can be made by those skilled in the art. For example, the conventional comparators 16, 17 and 18 can alternatively be constructed with FET's, UJT's or other devices which provide a binary output as a function of the input level. In the description of FIG. 3, the operations of the coupling capacitors C, the pull-up resistors R1, the pull-down resistors R2 and other standard components have been generally ignored since their functions and operations are well known.

Figure 4:
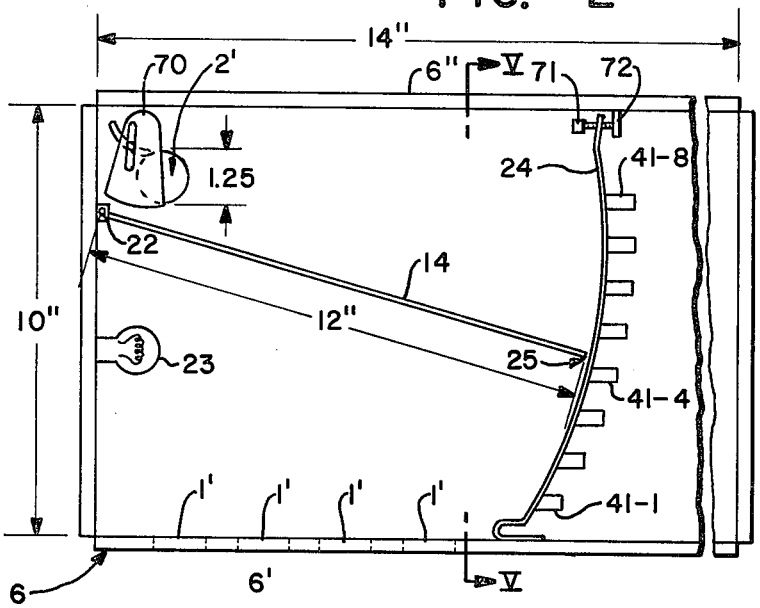
FIG. 4 depicts a plane, front view of one differential pressure sensor utilized in the present invention.
Figure 5:
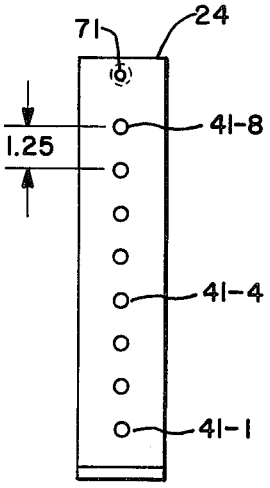
FIG. 5 depicts a plane, end view of the vane follower as taken along a section V—V in FIG. 4.
Figure 6:
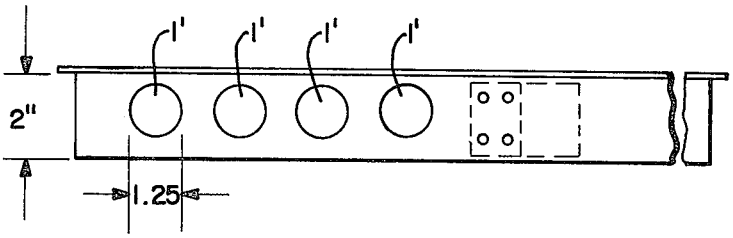
FIG. 6 depicts a plane, bottom view of the differential pressure sensor of FIG. 4.

Differential Sensor — FIG. 4, FIG. 5 and FIG. 6

In FIG. 4, one preferred embodiment of the differential pressure sensor 6 of FIG. 1 is shown in greater detail. The sensor 6 includes a chamber bounded by a bottom wall 6' and a top wall 6'' where the chamber is approximately 10 inches high. The chamber is also enclosed by two end walls about 14 inches apart. The front and back walls are about 2 inches apart. Within the inner chamber, a vane 14 is rotatably mounted at a pivot point 22. Vane 14 is approximately 12 inches long by 2 inches wide and is designed to fit and move within the sensor 6 chamber. In one embodiment vane 14 is constructed with an aluminum frame around its perimeter which is ½ inch wide and 0.01 inch thick. The open space in the center of the frame is covered with an aluminum foil approximately 0.0005 inch thick. The sensor walls and the vane are constructed to provide approximately a 0.040 inch clearance between the vane and the front and back walls.

Sensor 6 also includes a vane follower 24 which describes an arc about the pivot point 22. Follower 24 provides a means for adjusting the equilibrium position of vane 14 for a given differential pressure. Follower 24 is displaced from the arc described by vane 14 about pivot point 22 with a gap of between a clearance near zero up to approximately 0.375 inch. Vane follower 24 includes an adjustment bolt 71 which operates against stop 72 to adjust the gap between vane 14 and follower 24. Follower 24 is rigidly fixed to the bottom wall 6' and by its own spring action is urged in the direction of stop 72. Adjustment of bolt 71 therefore adjusts the gap 25 between the vane follower 24 and the vane 14. The adjustment is made to insure that vane 14 is rotated with its end above photocell 41—4 for a given equilibrium differential pressure for a particular enclosure.

Attached to the vane follower 24 are eight photocells 41—1 through 41—8 which could, of course, be a greater or lesser number. FIG. 5 is an end view of the vane follower along the section line V—V of FIG. 4. The photocells 41 are spaced apart approximately 1.25 inches. For greater sensitivity, more photocells with closer spacing can be employed.

In the bottom wall 6' of sensor 6, intake ports 1' are located for allowing air into the chamber of sensor 6 below vane 14. An exit port 2' is located above vane 14. Each of the ports has a diameter of about 1.25 inches. A differential pressure between the enclosure and the external environment causes air to enter ports 1', flow past vane 14, and exit through port 2'. The opening of the exit port 2' is adjusted by an adjustable sliding valve 70 which changes the rate of air flow through sensor 6 for a given differential pressure. The entry ports 1' are shown more clearly in the bottom view of FIG. 6. Sliding valves or other adjustable throttling means can be employed over the entry ports if desired.

Vane 14 having dimensions of 12 by 2 inches provides a high degree of sensitivity. Other vane shapes can be employed also. In general, the length to width ratio of the vane determines the sensitivity of the vane to changes in air flow. The higher the length to width ratio (6 in the above embodiment) the greater the sensitivity of the vane for a given change in air flow. The linearity of the vane position as a function of the differential pressure between the input port 1' and the output port 2' can be altered by adjusting the gap 25 between vane 14 and follower 24. For example, when the top of vane follower 24 is moved to the right, a larger gap is created near photocell 41—8 than the gap near photocell 41—4. Similarly, the gap at photocell 41—4 is greater than the gap at 41—1. The variation in vane position as a function of differential pressure for various gaps 25 is understood with reference to FIG. 7.

Figure 7:
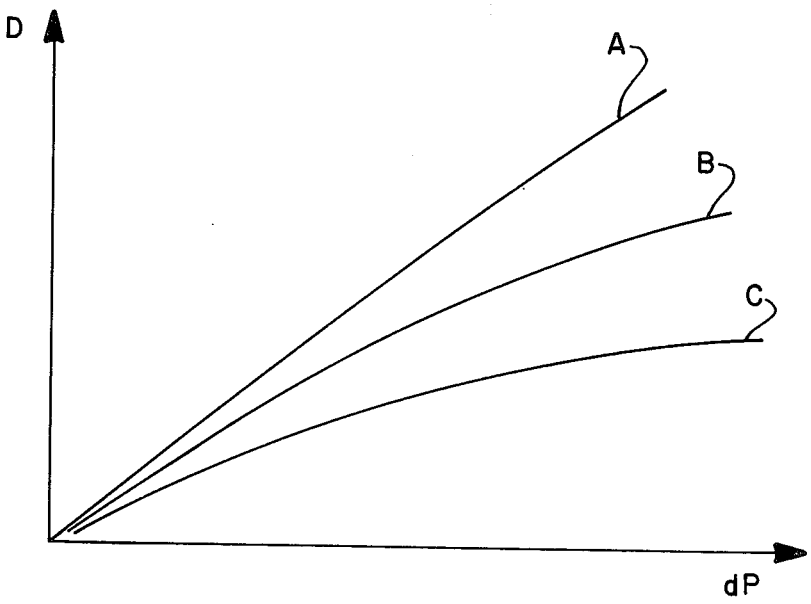
FIG. 7 depicts graphs representative of vane position as a function of differential air pressure between the enclosure and the external environment.

In FIG. 7, curves A, B and C represent the angular displacement, D, of the vane 14 around pivot 22 versus the differential pressure, dP, between the intake port 1' and the exhaust port 2' for different size gaps 25. Curve A represents a follower which is uniformly close to the arc described by the end of vane 14. Curve B depicts a follower which is farther away from the arc described by the vane at photocell 41—8 than it is at photocell 41—1. Curve C depicts an even greater displacement between the vane follower 24 at photocell 41—8 than at a photocell 41—1. It is evident from FIG. 7 that the pressure displacement characteristics of sensor 6 may be adjusted in a non-linear manner by adjustment of the gap between vane and follower.

The need for adjustments in the pressure displacement characteristics arises because each building or enclosure is likely to have different differential pressure characteristics with respect to its external environment. For a particular enclosure in a particular environment, the equilibrium position of the vane must be initially adjusted. The different characteristics arise for example because of different wind patterns which can be present around different buildings, because of the differences in the number of leaks in the structure and because of the different sizes of enclosures.

It has been found that for a 1,500 square foot building (12,000 cubic feet) a fan which displaces 500 cubic feet of air per minute is satisfactory for use with the differential sensor of FIG. 4. The size of the fan is not critical, however, and fans ranging from 250 cubic feet per minute to 1,500 cubic feet per minute are also satisfactory. The differential pressure produced is frequently less than 0.001 inch of water.

Figure 8:
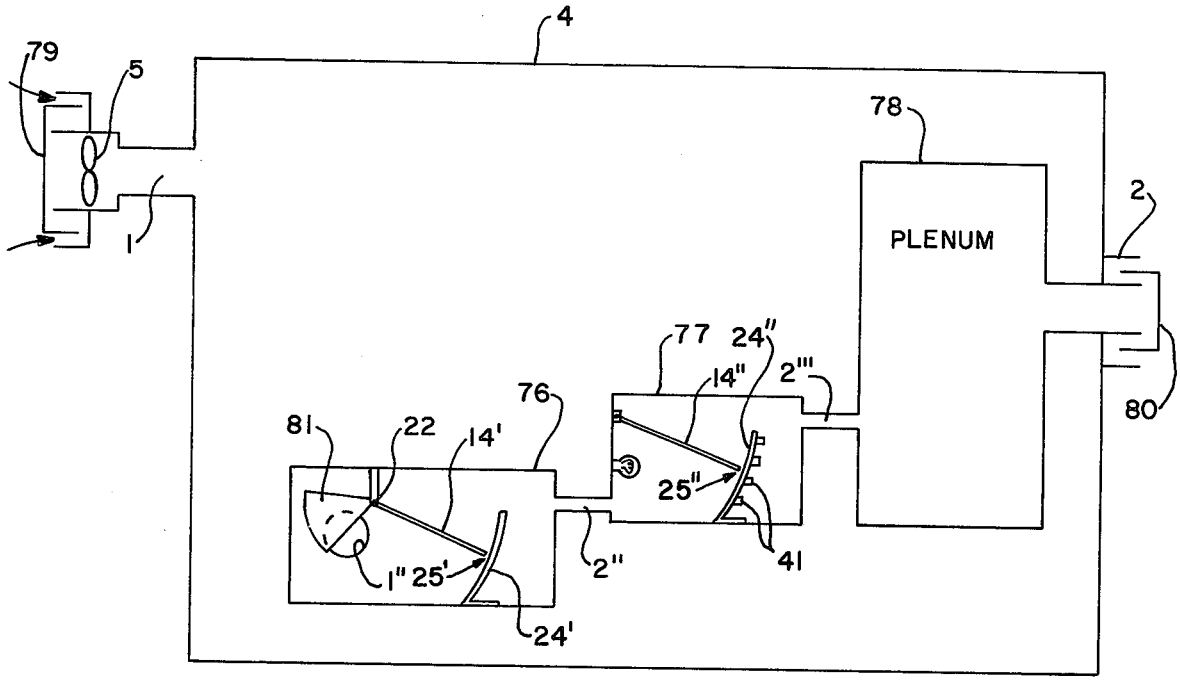
FIG. 8 depicts an alternate embodiment of the differential sensor which includes a number of air flow features which may be used singly or in combination.

Differential Sensor Controls — FIG. 8

Although the control elements in FIG. 4 are generally adequate, the additional controls of FIG. 8 are also useful. The use of non-linear controls, like the gap adjustment in FIG. 4 or additional controls to be described in FIG. 8, permits the differential sensor to operate over a large range of pressure differences that would not be possible with a practical linear system. In addition, when properly phased, the non-linearity of the response assists in reducing those wind gust effects which occur within the "time window" period of generator 19 in FIG. 1.

Coordinated choices of vane dimensions (length and width), mass, stiffness, side clearance, angular travel, stop placement and restoring force permit optimizing static sensitivity and dynamic response characteristics for a particular application. By balancing the characteristics of the differential sensor with the electronic characteristics of the signal processing circuitry, the intrusion detection apparatus is made operable over a wide variety of operating conditions.

In FIG. 8, the enclosure 4, the fan 5, the input port 1 and the output port 2 are all the same as generally described in connection with FIG. 1. The input port 1 and output port 2 are additionally partially covered by baffles 79 and 80 which are useful in reducing the effects of gusts. The differential sensor includes a first stage 76 and a second stage 77 followed by a pressure reference chamber (plenum) 78.

In the two-stage tandem vane system of FIG. 8, stage 76 acts as a throttling, non-linear flow control device for stage 77. Stage 76 is selected to have a non-linear response characteristic with vane 14' having a large mass (inertia), having damping or having both. Stage 76 therefore provides a nearly uniform average pressure differential for the second stage 77 thus permitting stage 77 to have high sensitivity to minor variations in pressure difference. The non-linear characteristic of vane 14' results from throttle valve 81. Valve 81 is rigidly connected to and moves with vane 14' to occlude inlet port 1'' as a function of vane position. The throttle valve 81 is an alternative for or can be used in conjunction with a non-uniform gap between follower 24' and vane 14'.

The pressure chamber 78 in FIG. 8 is typically 1 cubic foot or larger. For example, the spacing between studs in a wall of a typical house is particularly suitable, that is, a space of approximately 8 feet, by 3.5 inches by 15 inches.

While in the preferred differential sensor of FIG. 4, a thin, light aluminum vane of low inertia is employed, heavier materials can be used to produce greater inertia. To achieve a similar effect, the vane can be connected to a damper. One such damper is, for example, a magnet attached to move with the vane and to couple magnetically a conducting material fixed with respect to the vane. The magnetic coupling between the moving magnet and the fixed conducting material functions as a drag on vane movement. Of course, the conducting material can be attached to the vane and the magnet located in a non-moving position.

While a number of variations in the differential sensor and in the air flow system have been suggested for adjustment and control, other variations are of course possible and will be appreciated by those skilled in the art. These variations are employed both to establish a selected equilibrium condition and to control response to non-intrusion-caused differential pressure changes. If the differential pressure sensor is allowed to respond to all differential pressure changes, undesirable false alarm signals are generated. The mechanical control of air flow characteristics is particularly useful in eliminating the effects of high frequency components of differential pressure changes. Not all non-intrusion-caused changes, however, are eliminated by air flow controls. In order to provide reliable intrusion detection, additional filtering of the electrical signal output from the differential sensor desirable as previously described in connection with FIGS. 1 through 3.

While the differential sensor in the preferred embodiment of FIG. 4 employs discrete detectors (8 photocells), the detection of vane position can be achieved using well known position measuring transducers. For example, capacitance variation, infra-red sensing, laser beams ultrasonic reflection, electromagnetic fields, potentiometers, synchros, or resolvers can be employed. When discrete detectors are employed, the number of detectors can be increased or decreased to adjust the sensitivity of detection.

It should be noted in connection with the present invention that the initial position of the vane is moved above some predetermined level (photocell 41—4) in order to set the validating circuit. Once the validating circuit has been set, however, the equilibrium position of the vane is free to float up or down. Changes in environmental conditions frequently cause the equilibrium position of the vane to move from its initial location to some new equilibrium location. These changes in the equilibrium position do not distrub the proper operation of the system. The directional sensor is operative to detect changes in the position of the vane relative to its most recent equilibrium position. As is apparent in FIG. 2, capacitor 65 in the unilateral integrator 10 is continuously discharging through the resistor 67. Although changes in the equilibrium position may result in a signal across the capacitor 65, that signal is discharged through resistor 67. The mechanical damping and the electrical signal processing of the FIG. 1 apparatus are effectively a band pass filter. Only those changes in differential pressure which have sufficient amplitude within the frequency of response of the apparatus are allowed to trigger the alarm signal.

While in a preferred embodiment, the pressurizing means is a positive pressure fan for causing a higher pressure inside the enclosure than out, other pressurizing means can be employed. For example, a fan can be connected to partially evacuate the enclosure. The pressurizing means can be a pressurized tank which discharges into the enclosure to raise the pressure in the enclosure relative to the external environment. Further, the pressurizing means can be a passive device such as wind funnel having a small opening into the enclosure and a large opening in an external environment where the air flow (wind) into the funnel elevates the pressure within the enclosure.

While the invention has been particularly shown and described with reference to preferred embodiments thereof it will be understood by those skilled in the art that various changes in form and details may be made therein without departing from the spirit and the scope of the invention.

What is claimed is:

1. An intrusion detection apparatus for detecting intrusions into an enclosure wherein a pressure differential in a medium is maintained between the enclosure and the external environment, the improvement comprising:

sensor means connected between the enclosure and the external environment for providing an electrical signal which varies over a plurality of values within the extreme values of a range as a function of changes in the differential pressure between the enclosure and the external environment, signal processing means for detecting predetermined properties in said electrical signal to distinguish between intrusion-caused changes and non-intrusion-caused changes in said differential pressure.

2. The apparatus of claim 1 wherein said signal processing means includes time window generator means for providing a period for detecting said electrical signal for intrusion-caused variations.

3. The apparatus of claim 1 including directional sensor means for generating said electrical signal with an amplitude proportional to those changes in differential pressure which are in the direction of intrusion-caused changes in differential pressure.

4. The apparatus of claim 1 wherein said signal processing means includes amplitude detector means for detecting changes in said electrical signal which exceed a predetermined amplitude.

5. The apparatus of claim 1 wherein said apparatus includes alarm means for generating an alarm signal in response to said signal processing means detecting predetermined properties in said electrical signal and includes validating circuit means for selectively inhibiting said alarm signal.

6. The apparatus of claim 5 wherein said validating circuit means includes means for detecting when a predetermined differential pressure has been detected by said sensor means.

7. The apparatus of claim 5 wherein said validating circuit means includes enable store means for storing an enable signal, armed stored means for storing an armed signal when set to enable said alarm means, means for initially setting said enable store means while said armed store means is not set to produce a ready signal, and means for thereafter setting said armed store means and removing said ready signal.

8. The apparatus of claim 7 wherein said validating circuit means includes means to set said armed store means in response to a differential pressure change detected by said sensor means.

9. The apparatus of claim 1 wherein said sensor means includes an unbalanced vane urged in one direction by a restoring force and urged in the opposite direction as a function of said differential pressure.

10. The apparatus of claim 9 wherein said sensor means includes a vane follower positioned in close proximity to said vane whereby a gap is formed between said vane and said vane follower, adjustment means for adjusting said gap whereby the equilibrium position of said vane is adjustable by adjusting said gap.

11. The apparatus of claim 10 wherein said adjustment means includes means for adjusting said vane follower to produce a variable gap between said vane and said vane follower where said gap varies as a non-linear function of vane position whereby vane position varies as a non-linear function of said differential pressure.

12. The apparatus of claim 9 further including a throttle valve connected to said vane for adjusting the flow through said sensor means as a function of the vane position.

13. The apparatus of claim 1 wherein said sensor means includes a vane positioned as a function of said differential pressure and includes a plurality of detector means energized as a function of the position of said vane for producing said electrical signal.

14. The apparatus of claim 1 wherein said sensor means includes, a first differential sensor having a first unbalanced vane urged in one direction by a restoring force and urged in the opposite direction as a non-linear function of said differential pressure, said first differential sensor having a reduced differential pressure on its output which is a non-linear function of said differential pressure, a second differential sensor, fluidly connected in tandem with said first differential sensor between the enclosure and the external environment, having a second unbalanced vane urged in one direction as a function of said reduced differential pressure.

15. The apparatus of claim 1 including access control means for enabling and disabling said signal processing means.

16. The apparatus of claim 1 including pressurizing means connected between said enclosure and said external environment operable for establishing said differential pressure between said enclosure and said external environment.

17. An intrusion detection apparatus for detecting intrusions into an enclosure wherein a differential pressure in a medium is maintained between the enclosure and the external environment comprising:

sensor means connected to conduct a medium between the enclosure and the external environment with a rate of flow which is a function of said differential pressure, said sensor means including a movable vane urged in one direction by a restoring force and urged in the opposite direction by the flow of said medium whereby the movement of said vane from an equilibrium position is a function of said rate of flow, including electrical means for providing detection signals as a function of said movement, said electrical means including integrator means for integrating said detection signals to form an integrated signal having an amplitude proportional to changes in position of said vane, said integrator means including means for discharging said integrator at an exponential rate and means for limiting integration unilaterally with respect to a predetermined amplitude level, signal processing means including means for producing a threshold signal when the amplitude of said integrated signal exceeds a predetermined amplitude, including means for generating a time window for a predetermined duration commencing a predetermined time after a change in position of said vane, and including means for producing an alarm signal when said threshold signal occurs during said time window in order to indicate an intrusion-caused change in said differential pressure.

18. The apparatus of claim 17 wherein said apparatus includes validating circuit means for selectively inhibiting said alarm signal.

19. The apparatus of claim 18 wherein said validating said circuit means includes means for inhibiting said alarm signal until said vane is in said equilibrium position.

20. The apparatus of claim 18 wherein said validating said circuit means includes enable store means for storing an enable signal; armed store means for storing an armed signal, when set, to enable said alarm means; means for initially setting said enable store means while said armed store means is not set to produce a ready signal, and means for thereafter setting said armed store means and removing said ready signal.

21. The apparatus of claim 17 wherein said sensor means includes a vane follower positioned in close proximity to said vane to form a gap between said vane and said vane follower and includes adjustment means for adjusting said gap whereby said equilibrium position is moved by adjusting said adjustment means.

22. The apparatus of claim 21 wherein said adjustment means includes means for adjusting said gap as a non-linear function of vane position whereby the movement of said vane is a non-linear function of said differential pressure.

23. The apparatus of claim 1 wherein said sensor means includes means urged in one direction by a restoring force and urged in the opposite direction as a function of said differential pressure.

24. The apparatus of claim 1 wherein said sensor means includes a vane urged in one direction by a restoring force and urged in the opposite direction as a function of said differential pressure.

* * * * *